US008728701B2

(12) United States Patent
Mine et al.

(10) Patent No.: US 8,728,701 B2
(45) Date of Patent: May 20, 2014

(54) PRODUCTION PROCESS OF TONER FOR ELECTROSTATIC IMAGE DEVELOPMENT

(75) Inventors: Tomoko Mine, Tokyo (JP); Saburou Hiraoka, Tokyo (JP); Tomomi Oshiba, Tokyo (JP); Tatsuya Nagase, Tokyo (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 59 days.

(21) Appl. No.: 13/449,405

(22) Filed: Apr. 18, 2012

(65) Prior Publication Data

US 2012/0270149 A1 Oct. 25, 2012

(30) Foreign Application Priority Data

Apr. 25, 2011 (JP) ..... 2011-096943

(51) Int. Cl.
*G03G 5/00* (2006.01)

(52) U.S. Cl.
USPC ..... 430/137.14

(58) Field of Classification Search
USPC ..... 430/137.14
See application file for complete search history.

(56) References Cited

U.S. PATENT DOCUMENTS

| | | | | |
|---|---|---|---|---|
| 2005/0165132 | A1 | 7/2005 | Hawkins et al. | |
| 2009/0111038 | A1 * | 4/2009 | Shin et al. | 430/48 |
| 2010/0196813 | A1 | 8/2010 | Shin et al. | |

FOREIGN PATENT DOCUMENTS

| | | |
|---|---|---|
| CN | 1148956 | 5/1997 |
| CN | 101144994 | 3/2008 |
| JP | 2003-66648 | 3/2003 |
| JP | 2009-145885 | 7/2009 |

OTHER PUBLICATIONS

European Search Report EP 12 16 4036.
English Translation of Chinese Office Action, Date of Issuance: Sep. 16, 2013, Application No. 201210122828.5 (8 pages).

* cited by examiner

*Primary Examiner* — Mark A Chapman
(74) *Attorney, Agent, or Firm* — Lucas & Mercanti, LLP

(57) ABSTRACT

The production process is a production process of a toner for electrostatic image development, which is composed of toner particles containing at least a binder resin. The process has an aggregating and fusion-bonding step of adding a aggregating agent containing polysilicato-iron into an aqueous medium in which fine binder resin particles formed of the binder resin have been dispersed, thereby aggregating the fine binder resin particles, and an aggregation stopper-adding step of adding an aggregation stopper composed of a polyvalent organic acid or a salt thereof. In the production process of the toner for electrostatic image development, the polyvalent organic acid or the salt thereof is preferably an amino acid or a salt thereof.

9 Claims, No Drawings

PRODUCTION PROCESS OF TONER FOR ELECTROSTATIC IMAGE DEVELOPMENT

This Application claims the priority of Japanese Patent Application No. 2011-096943 filed on Apr. 25, 2011, the contents of which are incorporated herein by reference.

TECHNICAL FIELD

The present invention relates to a production process of a toner for electrostatic image development, which is used in image formation of an electrophotographic system.

BACKGROUND ART

A production process of a toner (hereinafter may also be referred to as "a toner" merely) for electrostatic image development according to a chemical process has such advantages that energy required for production is small, the particle size of the resulting toner can be made small, and occurrence of a finely powdered component can be inhibited.

Among those, an emulsification aggregation process is a process in which a dispersion of fine binder resin particles formed of a binder resin prepared by emulsion polymerization or the like is mixed with a dispersion of other toner particle forming components such as fine colorant particles as needed, a aggregating agent is added, thereby aggregating these particles, an aggregation stopper is added, as needed, to control the particle size of aggregated particles, and further the shape of the fine binder resin particles is controlled by fusion bonding between them, thereby producing toner particles.

A process of utilizing polysilicato-iron, which is an inorganic polymer, as the aggregating agent in this emulsification aggregation process is disclosed (see Patent Literature 1).

When polysilicato-iron is used as the aggregating agent, desired toner particles can be obtained with a small amount of the aggregating agent because the polysilicato-iron is a compound comprising iron and silica as main component, and so a charge-neutralizing reaction by an iron salt and a crosslinking action by polymerized silicic acid are caused.

CITATION LIST

Patent Literature

Patent Literature 1: Japanese Patent Application Laid-Open No. 2009-145885

SUMMARY OF INVENTION

Technical Problem

However, it has been found that even if an alkali compound is used as the aggregation stopper like the process disclosed in Patent Literature 1, a sufficient aggregation-relaxing effect is not achieved, and so there is a problem that difficulties are encountered on the control of a particle size and the sharpening of a particle size distribution of the resulting toner. It has also been found that when a color toner containing a colorant is produced, a problem that the color of the color toner becomes dull to fail to form an image having high saturation is caused.

The present invention has been made in view of the foregoing circumstances and has its object the provision of a production process of a toner for electrostatic image development, by which excellent toner particle size-controlling ability and moreover the sharpening of a particle size distribution thereof are achieved, and a color toner attaining high saturation can be produced.

Solution to Problem

The present inventors have carried out an extensive investigation as to the control of a particle size and the sharpening of a particle size distribution in a toner, and the saturation of a color toner in a system using a aggregating agent containing polysilicato-iron. As a result, it has been found that an aggregation stopper is related thereto, and the above problem can be solved by a specific aggregation stopper, thus leading to completion of the present invention.

According to the present invention, there is provided a production process of a toner for electrostatic image development, which comprises toner particles containing at least a binder resin, the process comprising:

an aggregating and fusion-bonding step of adding a aggregating agent containing polysilicato-iron into an aqueous medium in which fine binder resin particles formed of the binder resin have been dispersed, thereby aggregating the fine binder resin particles, and an aggregation stopper-adding step of adding an aggregation stopper composed of a polyvalent organic acid or a salt thereof.

In the production process of the toner for electrostatic image development of the present invention, the polyvalent organic acid or the salt thereof may preferably be an amino acid, a polyphosphonic acid or a salt thereof, or an amino acid or a salt thereof, or an amino acid having five or more carboxyl groups and/or hydroxyl groups or a salt thereof.

In the production process of the toner for electrostatic image development of the present invention, fine colorant particles formed of a colorant may preferably be aggregated together with the fine binder resin particles in the aggregating and fusion-bonding step.

In the production process of the toner for electrostatic image development of the present invention, the polysilicato-iron may preferably have an average molecular weight of 200,000 to 500,000 daltons.

In the production process of the toner for electrostatic image development of the present invention, the amount of the polysilicato-iron added in the aggregating and fusion-bonding step may preferably be 1 to 100 mmol in terms of $[Fe_2O_3]$ per 1 L of the aqueous medium.

In the production process of the toner for electrostatic image development of the present invention, a temperature at which the aggregating agent is added in the aggregating and fusion-bonding step may preferably be not higher than a glass transition point of the binder resin.

In the production process of the toner for electrostatic image development of the present invention, the amount of the aggregation stopper added into the aqueous medium may preferably be 1 to 500 mmol per 1 L of the aqueous medium.

Advantageous Effects of Invention

According to the production process of the toner of the present invention, the polyvalent organic acid or the salt thereof is used as the aggregation stopper when polysilicato-iron is used as the aggregating agent, whereby a sufficient aggregation-relaxing effect can be achieved, and moreover coloring by the polysilicato-iron can be inhibited. As a result, excellent toner particle size-controlling ability and moreover the sharpening of a particle size distribution thereof are achieved, and the color of the resulting toner does not become dull. Accordingly, a toner for electrostatic image development, which has desired particle size and particle size distribution and attains high saturation, can be produced.

DESCRIPTION OF EMBODIMENTS

The present invention will hereinafter be described specifically.

Production Process of Toner:

The production process of the toner according to the present invention is a process for producing a toner composed of toner particles containing at least a binder resin and optionally containing a colorant, a parting agent, a charge control agent and the like, said process having an aggregating and fusion-bonding step of adding a aggregating agent containing polysilicato-iron into an aqueous medium in which fine binder resin particles formed of the binder resin have been dispersed, thereby aggregating the fine binder resin particles and growing the resultant aggregated particles, and an aggregation stopper-adding step of adding an aggregation stopper (hereinafter may also be referred to as "the specific aggregation stopper") composed of a polyvalent organic acid or a salt thereof, thereby stopping the growth of the aggregated particles.

Here, the term "aqueous medium" means a medium composed of 50 to 100% by mass of water and 0 to 50% by mass of a water-soluble organic solvent. As examples of the water-soluble organic solvent, may be mentioned methanol, ethanol, isopropanol, butanol, acetone, methyl ethyl ketone and tetrahydrofuran, and it is preferably an organic solvent which does not dissolve the fine binder resin particles.

A specific example of the production process of the toner according to the present invention is described. For example, when a toner containing a colorant is desired, the process comprises:

(1) a fine colorant particle dispersion-preparing step of preparing a dispersion with fine colorant particles dispersed in an aqueous medium, (2) a fine binder resin particle dispersion-preparing step of preparing a dispersion with fine binder resin particles optionally containing internal additives such as a parting agent and a charge control agent dispersed in an aqueous medium, (3) an aggregating and fusion-bonding step of aggregating and fusion-bonding the fine binder resin particles and the fine colorant particles, and optionally fine particles of other toner particle forming components in the aqueous medium to grow the resultant-aggregated particles, (4) an aggregation stopper adding step of adding the specific aggregation stopper into the aqueous medium to stop the aggregation, thereby stopping the growth of the aggregated particles, (5) an aging step of aging the aggregated particles with thermal energy to adjust the shape of the particles, thereby obtaining toner particles, (6) a filtering and washing step of separating the toner particles from the aqueous medium by filtration and removing the aggregating agent, the aggregation stopper, a surfactant and/or the like from the toner particles, and (7) a drying step of drying the toner particles subjected to the washing treatment, and the process may optionally comprise (8) an external additive adding step of adding an external additive to the toner particles subjected to the drying treatment.

(1) Fine Colorant Particle Dispersion-Preparing Step:

This fine colorant particle dispersion-preparing step is optionally conducted when the colorant is introduced into the toner particles.

The dispersion of the fine colorant particles is obtained by dispersing the colorant in an aqueous medium.

Publicly known various methods such as use of a dispersing machine may be adopted as a dispersing method.

The average particle size of the fine colorant particles in the dispersion of the fine colorant particles preferably falls within a range of, for example, 10 to 300 nm in terms of a volume-based median diameter. Incidentally, the volume-based median diameter is measured by means of a dynamic light scattering type particle size analyzer "MICROTRACK UPA150" (manufactured by Nikkiso Co., Ltd.).

Colorant:

As the colorant contained in the toner according to the present invention, may be used publicly known various colorants such as carbon black, black iron oxide, dyes and pigments.

Examples of the carbon black include channel black, furnace black, acetylene black, thermal black and lamp black. Examples of the black iron oxide include magnetite, hematite and iron titanium trioxide.

Examples of the dyes include C.I. Solvent Red: 1, 49, 52, 58, 63, 111 and 122; C.I. Solvent Yellow: 19, 44, 77, 79, 81, 82, 93, 98, 103, 104, 112 and 162; and C.I. Solvent Blue: 25, 36, 60, 70, 93 and 95.

Examples of the pigments include C.I. Pigment Red: 5, 48:1, 48:3, 53:1, 57:1, 81:4, 122, 139, 144, 149, 150, 166, 177, 178, 222, 238 and 269; C.I. Pigment Orange: 31 and 43; C.I. Pigment Yellow: 14, 17, 74, 93, 94, 138, 155, 156, 158, 180 and 185; C.I. Pigment Green 7; and C.I. Pigment Blue: 15:3 and 60.

As a colorant for obtaining a toner of each color, colorants for each color may be used either singly or in any combination thereof.

The content of the colorant in the toner is preferably 1 to 10% by mass, more preferably 2 to 8% by mass based on the toner. If the content of the colorant is too small, desired tinting strength may possibly be not attained to the resulting toner. If the content of the colorant is too large on the other hand, isolation of the colorant or its adhesion to a carrier or the like may occur in some cases to exert an influence on charge property.

A method for introducing the colorant into the toner particles is not limited to the method like this embodiment, in which the fine colorant particles formed of the colorant alone are prepared separately from the fine binder resin particles, and these fine particles are aggregated, and for example, a method, in which a dispersion of fine particles, in which the binder resin and the colorant are present mixedly at a molecular level, is prepared in the fine binder resin particle dispersion-preparing step, and these fine particles are aggregated, may also be selected.

(2) Fine Binder Resin Particle Dispersion-Preparing Step:

The fine binder resin particles may be prepared by a preparation process publicly known in the technical field of toners, for example, an emulsion polymerization process, a phase inversion emulsification process, a suspension polymerization process or a dissolution suspension process. Among others, the preparation by the emulsion polymerization process is preferred.

In the emulsion polymerization process, a polymerizable monomer to form the binder resin is dispersed in an aqueous medium to form emulsion particles, and a polymerization initiator is then poured to polymerize the polymerizable monomer, thereby forming fine binder resin particles.

Binder Resin:

As the binder resin making up the toner particles, may be used publicly known various resins such as vinyl resins such as styrene resins, (meth)acrylic resins, styrene-(meth)acrylic copolymer resins and olefin resins, polyester resins, polyamide resins, polycarbonate resins, polyether, polyvinyl acetate resins, polysulfone, epoxy resins, polyurethane resins, and urea resins. These resins may be used either singly or in any combination thereof.

When a vinyl resin is used as the binder resin, examples of the polymerizable monomer to form the binder resin include the following monomers.

(1) Styrene and Styrene Derivatives Such as:

styrene, o-methylstyrene, m-methylstyrene, p-methylstyrene, α-methylstyrene, p-phenylstyrene, p-ethylstyrene, 2,4-dimethylstyrene, p-tert-butylstyrene, p-n-hexylstyrene, p-n-octylstyrene, p-n-nonylstyrene, p-n-decylstyrene and p-n-dodecylstyrene.

(2) Methacrylic Ester Derivatives Such as:

methyl methacrylate, ethyl methacrylate, n-butyl methacrylate, isopropyl methacrylate, isobutyl methacrylate, t-butyl methacrylate, n-octyl methacrylate, 2-ethylhexyl methacrylate, stearyl methacrylate, lauryl methacrylate, phenyl methacrylate, diethylaminoethyl methacrylate and dimethylaminoethyl methacrylate.

(3) Acrylic Ester Derivatives Such as:

methyl acrylate, ethyl acrylate, isopropyl acrylate, n-butyl acrylate, t-butyl acrylate, isobutyl acrylate, n-octyl acrylate, 2-ethylhexyl acrylate, stearyl acrylate, lauryl acrylate and phenyl acrylate.

(4) Olefins Such as:

ethylene, propylene and isobutylene.

(5) Vinyl Esters Such as:

vinyl propionate, vinyl acetate and vinyl benzoeate.

(6) Vinyl Ethers Such as:

vinyl methyl ether and vinyl ethyl ether.

(7) Vinyl Ketones Such as:

vinyl methyl ketone, vinyl ethyl ketone and vinyl hexyl ketone.

(8) N-Vinyl Compounds Such as:

N-vinylcarbazole, N-vinylindole and N-vinylpyrrolidone.

(9) Others Such as:

vinyl compounds such as vinylnaphthalene and vinylpyridine, and acrylic acid and methacrylic acid derivatives such as acrylonitrile, methacrylonitrile and acrylamide.

In addition, a monomer having an ionic leaving group such as, for example, a carboxyl group, a sulfonic group or a phosphate group at its side chain may be used as the polymerizable monomer to form the vinyl resin. Specifically, the following monomers are mentioned.

Monomers having a carboxyl group include acrylic acid, methacrylic acid, maleic acid, itaconic acid, cinnamic acid, fumaric acid, monoalkyl esters of maleic acid, monoalkyl esters of itaconic acid, etc. Monomers having a sulfonic group include styrenesulfonic acid, allylsulfosuccinic acid, 2-acrylamido-2-methylpropanesulfonic acid, etc. In addition, monomers having a phosphate group include acid phosphooxy-ethyl methacrylate, etc.

A polyfunctional vinyl compound may also be used as the polymerizable monomer to provide the vinyl resin as one having a crosslinked structure. Examples of the polyfunctional vinyl compound include divinylbenzene, ethylene glycol dimethacrylate, ethylene glycol diacrylate, diethylene glycol dimethacrylate, diethylene glycol diacrylate, triethylene glycol dimethacrylate, triethylene glycol diacrylate, neopentyl glycol dimethacrylate and neopentyl glycol diacrylate.

When the polyester resin is used as the binder resin, a polyvalent carboxylic acid and a polyhydric alcohol are used as polymerizable monomers for forming the binder resin.

As examples of the polyvalent carboxylic acid, may be mentioned bivalent or still higher carboxylic acids, for example, dicarboxylic acids such as oxalic acid, malonic acid, succinic acid, glutaric acid, adipic acid, pimelic acid, suberic acid, azelaic acid, sebacic acid, maleic acid, fumaric acid, citraconic acid, itaconic acid, glutaconic acid, n-dodecylsuccinic acid, n-dodecenylsuccinic acid, isododecylsuccinic acid, isododecenylsuccinic acid, n-octyl-succinic acid and n-octenylsuccinic acid; aromatic dicarboxylic acids such as phthalic acid, isophthalic acid, terephthalic acid and naphthalenedicarboxylic acid; and trivalent or still higher carboxylic acids such as trimellitic acid, pyromellitic acid, and anhydrides and chlorides thereof. These compounds may be used either singly or in any combination thereof.

As examples of the polyhydric alcohol, may be mentioned dihydric or still higher alcohols, for example, diols such as ethylene glycol, diethylene glycol, triethylene glycol, 1,2-propylene glycol, 1,3-propylene glycol, 1,4-butanediol, 1,4-butylenediol, neopentyl glycol, 1,5-pentane glycol, 1,6-hexane glycol, 1,7-heptane glycol, 1,8-octanediol, 1,9-nonanediol, 1,10-decanediol, pinacol, cyclopentane-1,2-diol, cyclohexane-1,4-diol, cyclohexane-1,2-diol, cyclohexane-1,4-dimethanol, dipropylene glycol, polyethylene glycol, polypropylene glycol, polytetramethylene glycol, bisphenol A, bisphenol Z and hydrogenated bisphenol A; trihydric or still higher aliphatic alcohols such as glycerol, trimethylolethane, trimethylolpropane, pentaerythritol, sorbitol, trisphenol PA, phenol novolak and cresol novolak; and alkylene oxide adducts of the above-mentioned trihydric or still higher aliphatic alcohols. These compounds may be used either singly or in any combination thereof.

When the polyester resin is used as the binder resin, that having an acid value of 40 mg KOH/g or less and a hydroxyl value of 60 mg KOH/g or less is preferably used. The acid value and hydroxyl value are values measured according to the respective usual methods.

Polymerization Initiator:

When a polymerization initiator is used in the fine binder resin particle dispersion-preparing step, conventionally known various polymerization initiators may be used. As preferable specific examples of usable polymerization initiators, may be mentioned persulfates (potassium persulfate, ammonium persulfate, etc.). In addition, azo compounds (4,4'-azobis-4-cyanovaleric acid and salts thereof, 2,2'-azobis (2-amidinopropane) salts, etc.), peroxide compounds, and azobisisobutyronitrile, etc. may also be used.

Surfactant:

A surfactant may also be added into the aqueous medium, and conventionally known various anionic surfactants, cationic surfactants and nonionic surfactants may be used as the surfactant.

Chain Transfer Agent:

A generally used chain control agent may be used in the fine binder resin particle dispersion-preparing step for the purpose of controlling the molecular weight of the binder resin. No particular limitation is imposed on the chain transfer agent. As examples thereof, however, may be mentioned 2-chloroethanol, mercaptans such as octylmercaptan, dodecylmercaptan and t-dodecylmercaptan, and styrene dimer.

The fine binder resin particles may be formed as that having a two or more multilayer structure composed of resins different in composition from each other. In this case, a process in which a polymerization initiator and a polymerizable monomer are added into a dispersion of fine resin particles prepared by an emulsion polymerization treatment (first-stage polymerization) according to a method known per se in the art, and this system is subjected to a polymerization treatment (second-stage polymerization) may be adopted.

The average particle size of the fine binder resin particles obtained in the fine binder resin particle dispersion-preparing step is preferably within a range of 20 to 400 nm in terms of a volume-based median diameter.

The volume-based median diameter of the fine binder resin particles is a value measured by means of "Microtrack UPA-150" (manufactured by Nikkiso Co., Ltd.).

In addition to the binder resin, internal additives such as a parting agent and a charge control agent may be contained in the toner particles according to the present invention as needed.

Parting Agent:

No particular limitation is imposed on the parting agent, and as examples thereof, may be mentioned polyethylene wax, oxidized type polyethylene wax, polypropylene wax, oxidized type polypropylene wax, carnauba wax, paraffin wax, microcrystalline wax, Fischer-Tropsch wax, rice wax, candelilla wax and fatty acid esters.

The content of the parting agent in the toner particles is generally 0.5 to 25 parts by mass, preferably 3 to 15 parts by mass per 100 parts by mass of the binder resin.

Charge Control Agent:

Publicly known various compounds may be used as the charge control agent.

The content of the charge control agent in the toner particles is generally 0.1 to 10 parts by mass, preferably 0.5 to 5 parts by mass per 100 parts by mass of the binder resin.

(3) Aggregating and Fusion-Bonding Step:

In the aggregating and fusion-bonding step, a aggregating agent is added into an aqueous medium in which the fine binder resin particles and the fine colorant particles, and optionally fine particles of other toner forming components have been dispersed, and aggregated particles by aggregation of the fine binder resin particles are grown, and at the same time or after the aggregated particles are grown by the aggregation, the system is heated at a glass transition point of the fine binder resin particles or higher to fusion-bond the aggregated particles.

Flocculant:

In the present invention, polysilicato-iron is used as the aggregating agent.

Polysilicato-iron is a compound represented by a general formula $[SiO_2]_n.[Fe_2O_3]$ and having an average molecular weight of the order of 200,000 to 500,000 daltons, in which iron is introduced into a stable polymerized silicic acid.

By using this polysilicato-iron, higher cohesive force than the single use of an iron-based aggregating agent such as iron(II) chloride is developed by virtue of a charge-neutralizing action derived from iron and a crosslinking action by polymerized silicic acid.

The polysilicato-iron is preferably that having a molar ratio (Si/Fe) of silica to iron within a range of 0.25 to 3.0, and that having a molar ratio within a range of 0.25 to 1.0 is particularly preferred from the viewpoint of the ability to control the particle size distribution of the aggregated particles. Further, one that n in the above general formula is 0.5 to 6.0 is preferably used as the polysilicato-iron.

One kind of polysilicato-iron may be used singly, or two or more kinds of polysilicato-iron may be used in combination.

Another aggregating agent than polysilicato-iron may also be used together with the polysilicato-iron.

The amount of the aggregating agent added into the aqueous medium is preferably 1 to 100 mmol, more preferably 2 to 50 mmol in terms of $[Fe_2O_3]$ per 1 L of the aqueous medium.

No particular limitation is imposed on the temperature at which the aggregating agent is added in the aggregating and fusion-bonding step. However, the temperature is preferably not higher than the glass transition point of the binder resin.

The pH of the aqueous medium in the aggregating and fusion-bonding step is preferably controlled to 7 or lower. If the pH of the reaction system is higher than 7, the occurrence of coarse particles cannot be inhibited upon the aggregation, and so there is a possibility that the particle size distribution of the resulting toner may become broad.

When in the toner obtained by the production process of the toner according to the present invention, a sectional sample of the toner particles is prepared according to the CP method (cross section polisher method), and elemental analysis is conducted on this sample by EDS (energy dispersive X-ray spectroscopy), silica and iron are detected in the sample.

(4) Aggregation Stopper Adding Step:

The aggregation stopper adding step is a step of adding the specific aggregation stopper into the aqueous medium at the time the aggregated particles have come to have a desired particle size in the aggregating and fusion-bonding step as above, thereby lowering the cohesive force between or among the fine particles in the aqueous medium to stop the growth of the particle size.

Aggregation Stopper:

The specific aggregation stopper used in the production process of the toner according to the present invention is composed of a polyvalent organic acid or a salt thereof.

The polyvalent organic acid is a compound capable of donating two or more protons per one molecule or a compound having two or more electrolytic dissociation exponents, pKa values. Examples of the polyvalent organic acid include polycarboxylic acids that are compounds having two or more carboxyl groups in one molecule, oxoacids that are compounds having a carboxyl group and a hydroxyl group in one molecule, polyphosphonic acids that are compounds having two or more phosphonic groups in one molecule, amino acids that are compounds having a carboxyl group and an amino group (including an imino group) in one molecule, sulfonic acid compounds, amino acid compounds, phosphoric acid compounds, and sulfuric acid compounds.

Such a polyvalent organic acid or a salt thereof has heretofore been known to be capable of scavenging a metal ion as a chelating agent. However, the present inventors have found that it also exhibits an effect on the relaxation of the aggregating action of the polysilicato-iron having cohesive force by the metal ion and cohesive force by the crosslinking action of the polymerized silicic acid in combination. The present invention has been completed on the basis of this finding.

The mechanism that the aggregating action by the polysilicato-iron is effectively relaxed is guessed to be as follows.

That is, the polyvalent organic acid or the salt thereof is added into the aqueous medium containing the polysilicato-iron, whereby the acid group of the polyvalent organic acid first acts as a chelating agent to scavenge the iron ion of the polysilicato-iron, and so the surface charge-neutralizing action of the aggregated particles by the iron ion is weakened, thereby suppressing the cohesive force. In addition, the surface charge-neutralizing action of the aggregated particles is weakened, whereby electrostatic repulsive force acting between the surfaces of the aggregated particles and the polymerized silicic acid is strengthened, thereby inhibiting adsorption of the polymerized silicic acid on the aggregated particles, so that the crosslinking action by the polymerized silicic acid becomes hard to occur to further suppress the cohesive force.

Further, the acid group of the polyvalent organic acid acts as a chelating agent to scavenge the iron ion, whereby coloring of the resulting color toner by the iron ion is inhibited, thereby attaining high saturation for the color toner.

As specific examples of the specific aggregation stopper, may be mentioned compounds represented by the following formulae (1-1) to (11-21) and salts thereof.

(1-1) $HOOC—COOH$ (1-2) $HOOC—CH_2—COOH$ (1-3) $HOOC—(CH_2)_2—COOH$ (1-4) $HOOC—(CH_2)_3—COOH$ (1-5) $HOOC—(CH_2)_4—COOH$ (1-6) $HOOC—(CH_2)_5—COOH$ (1-7) $HOOC—(CH_2)_6—COOH$ (1-8) $HOOC—(CH_2)_7—COOH$ (1-9) $HOOC—(CH_2)_8—COOH$ (1-10) $HOOC—(CH_2)_9—COOH$ (1-11) $HOOC—(CH_2)_{10}—COOH$ (1-12) $HOOC—CH(CH_3)—COOH$ (1-13) $HOOC—C(CH_3)_2—COOH$ (1-14) $HOOC—CH(CH_3)CH_2—COOH$ (1-15) $HOOC—CH_2CH(CH_3)CH_2—COOH$ (1-16) $HOOC—CH_2C(CH_3)_2CH_2—COOH$ (1-17)

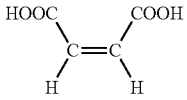

(1-18)

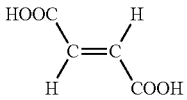

(1-19)

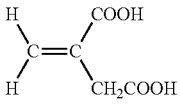

-continued (1-20)

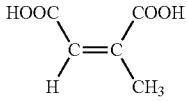

(1-21)

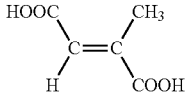

(1-22) $HOOC—CH_2CH=CH—COOH$ (1-23) $HOOC—CH=CHCH=CH—COOH$ (1-24) $HOOC—CH_2CO—COOH$ (1-25) $HOOC—CO—COOH$ (2-1) $HO—CH(CH_3)—COOH$ (2-2) $HO—CH_2CH_2—COOH$ (2-3) $HO—CH_2—COOH$ (2-4)

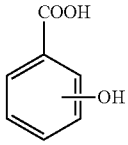

(2-5)

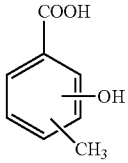

(2-6)

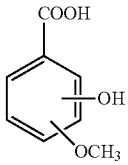

(2-7)

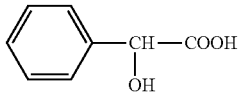

(2-8)

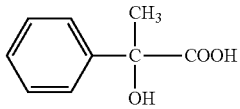

(2-9) $(C_6H_5)_2—C(OH)—COOH$ (2-10) $CH_3CH(CH_3)CH_2—CH(OH)—COOH$ (3-1) $HOOC—CH_2CH(OH)—COOH$ (3-2) $HOOC—CH(OH)—COOH$

-continued
(4-1)
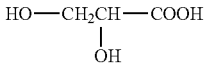
(4-2)
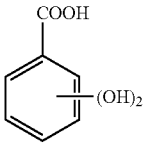
(4-3)
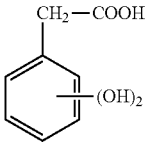
(4-4)
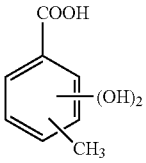
(4-5)
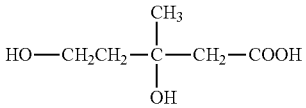
(4-6)
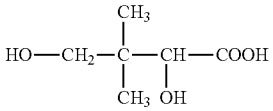
(5-1)
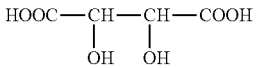
(6-1)
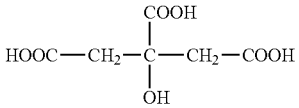
(6-2)
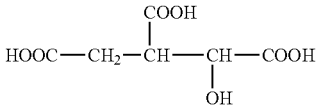
(7-1)
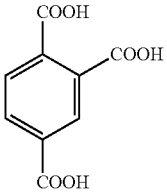
(7-2)
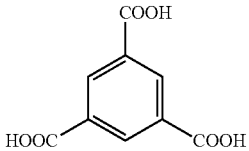
(7-3)
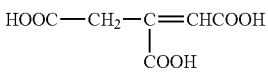
-continued
(7-4)
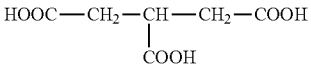
(7-5)
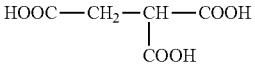
(7-6)
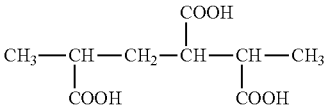
(7-7)
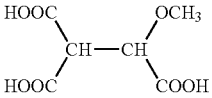
(8-1)
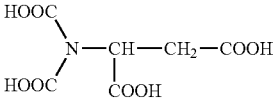
(8-2)
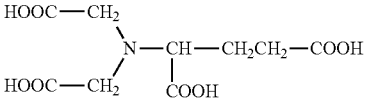
(8-3)
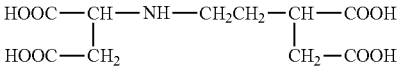
(8-4)
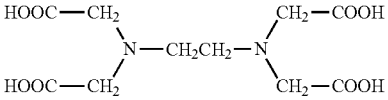
(8-5)
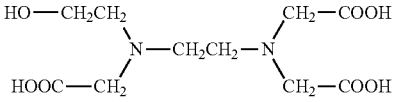
(8-6)
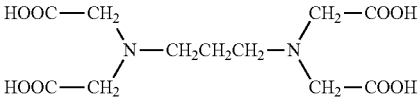
(8-7)
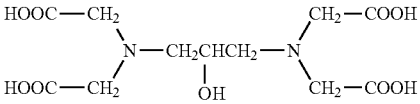
(9-1)
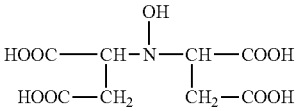
(9-2)
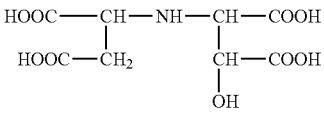
(10-1)
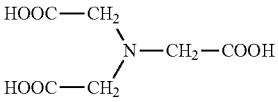

-continued
(10-2)
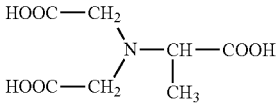
(10-3)
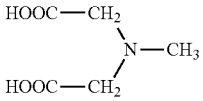
(10-4)
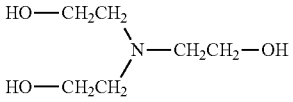
(10-5)
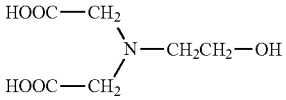
(10-6)
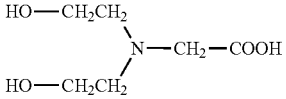
(10-7)
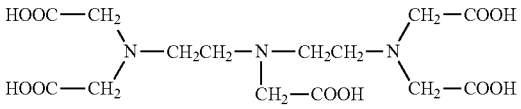
(10-8)
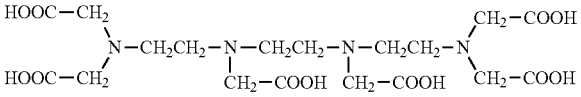
(11-1)
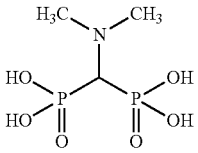
(11-2)
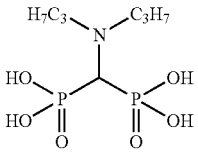
(11-3)
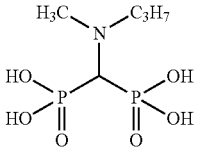
(11-4)
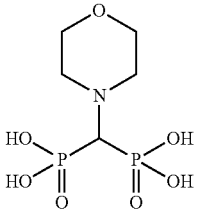
-continued
(11-5)
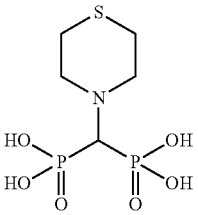
(11-6)
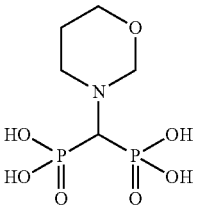
(11-7)
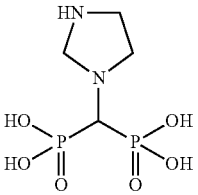
(11-8)
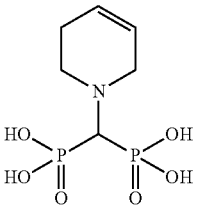
(11-9)
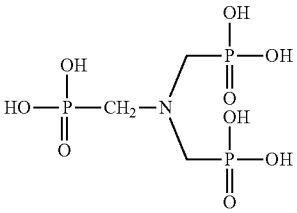
(11-10)
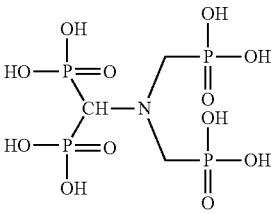
(11-11)
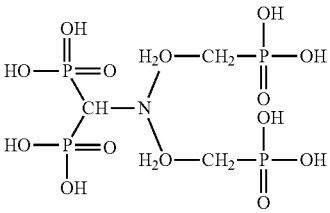

-continued (11-12)

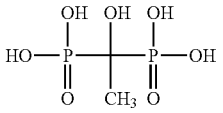

(11-13)

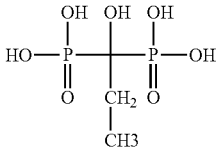

(11-14)

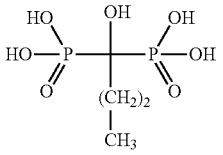

(11-15)

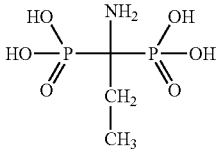

(11-16)

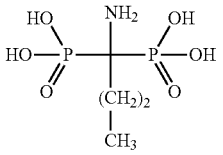

(11-17)

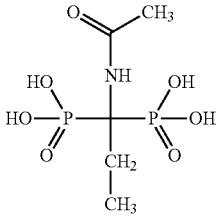

(11-18)

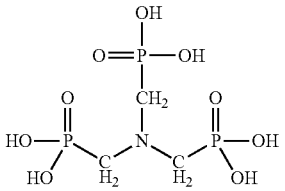

(11-19)

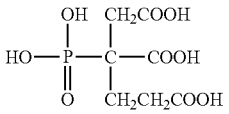

(11-20)

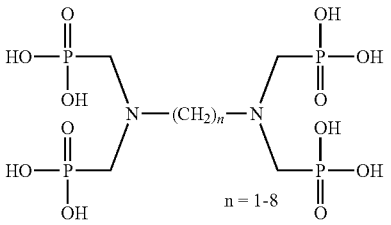

-continued (11-21)

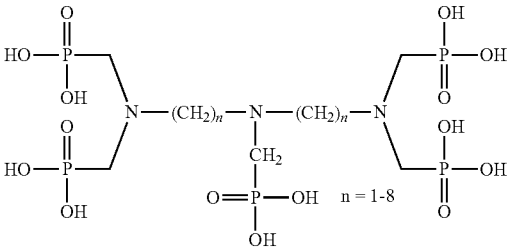

These aggregation stoppers may be used either singly or in any combination thereof.

Amino acids, polyphosphonic acids and salts thereof are preferably used as the specific aggregation stopper used in the production process of the toner according to the present invention, and such amino acids as represented by the formulae (8-1) to (10-3), and (10-5) to (10-8) and salts thereof are more preferably used. Among the amino acids and the salts thereof, amino acids having five or more carboxyl groups and/or hydroxyl groups and salts thereof are particularly preferably used.

The amount of the aggregation stopper added into the aqueous medium is preferably 1 to 500 mmol, more preferably 10 to 300 mmol per 1 L of the aqueous medium.

In the toner obtained by the production process of the toner according to the present invention, the polyvalent organic acid or the salt thereof is detected when an extract extracted from the toner with a mixed solvent of methanol and water is subjected to qualitative and quantitative analyses by ICP emission spectrometry, NMR spectroscopy, HPLC analysis and the like.

(5) Aging Step:

The aging step is conducted as needed. In this aging step, an aging treatment that the aggregated particles are aged with thermal energy until a desired shape is achieved is conducted.

(6) Filtering and Washing Step:

The filtering and washing step may be conducted according to a filtering and washing step generally conducted in a publicly known production process of toner particles.

In this filtering and washing step, the pH of the dispersion of the toner particles at the time filtration and washing are specifically conducted is preferably controlled to 1.0 to 5.0. The dispersion is controlled to such a pH, whereby the aggregating agent, surfactant, colorant, aggregation stopper, etc. that have not been taken in the toner particles can be effectively washed out.

(7) Drying Step:

This drying step may be conducted according to a drying step generally conducted in a publicly known production process of toner particles.

(8) External Additive Adding Step:

The toner particles described above may be used as a toner as they are. However, the toner particles may also be used in a state that what is called external additives such as a flowability improver and a cleaning aid have been added into the toner particles for the purpose of improving flowability, charge property, cleaning ability, etc.

Examples of the flowability improver include inorganic fine particles having a number-average primary particle size of the order of 10 to 1,000 nm and formed of silica, alumina, titanium oxide, zinc oxide, iron oxide, copper oxide, lead oxide, antimony oxide, yttrium oxide, magnesium oxide, barium titanate, calcium titanate, zinc titanate, ferrite, red iron oxide, magnesium fluoride, silicon carbide, boron carbide, silicon nitride, zirconium nitride, magnetite, magnesium stearate, calcium stearate, zinc stearate, etc.

These inorganic fine particles are preferably subjected to a surface treatment with a silane coupling agent, titanium coupling agent, higher fatty acid, silicone oil or the like for the purpose of improving dispersibility on the surfaces of the toner particles and environmental stability.

Examples of the cleaning aid include organic fine particles having a number-average primary particle size of the order of 10 to 2,000 nm, such as fine polystyrene particles, fine polymethyl methacrylate particles and fine styrene-methyl methacrylate copolymer particles.

Various fine particles may also be used as the external additive in combination.

The total amount of these external additives added is preferably 0.05 to 5 parts by mass, more preferably 0.1 to 3 parts by mass per 100 parts by mass of the toner particles.

As a mixing device for the external additives, may be used a mechanical mixing device such as a Henschel mixer and a coffee mill.

Particle Size of Toner Particles:

The average particle size of the toner according to the present invention is, for example, preferably 3 to 8 μm, more preferably 5 to 8 μm in terms of a volume-based median diameter. This average particle size can be controlled by the concentration of the aggregating agent used upon the production, the amount of the organic solvent added, a fusion bonding time and/or the composition of the binder resin.

The volume-based median diameter falls within the above range, whereby a very minute dot image of a level of 1,200 dpi can be faithfully reproduced.

The volume-based median diameter of the toner particles is a value measured and calculated by means of a measuring device with a computer system, in which a data processing software "Software V3.51" is mounted, connected to "Multisizer 3" (manufactured by Beckmann Coulter Co.). Specifically, 0.02 g of the toner is added to 20 mL of a surfactant solution (for example, a surfactant solution obtained by diluting a neutral detergent containing a surfactant component with pure water to 10 times for the purpose of dispersing the toner particles) to cause the toner to be intimate, and ultrasonic dispersion is then conducted for 1 minute to prepare a dispersion of the toner. This toner dispersion is poured into a beaker, in which "ISOTON II" (product of Beckmann Coulter Co.) has been placed, within a sample stand by a pipette until an indicator concentration of the measuring device reaches 8%. Here, the concentration is controlled to this range, whereby a reproducible measured value can be obtained. In the measuring device, the number of particles to be measured is counted as 25,000 particles, and an aperture diameter is controlled to 100 μm to calculate out frequency values with a range of 2 to 60 μm that is a measuring range divided into 256 portions. A particle size of 50% from the largest integrated volume fraction is regarded as a volume-based median diameter.

Particle Size Distribution of Toner Particles:

In the toner according to the present invention, a coefficient of variation (Cv value) in a volume-based particle size distribution of the toner particles is preferably 2 to 25%, more preferably 5 to 23%.

The coefficient of variation (Cv value) in the volume-based particle size distribution means that the degree of dispersion in the particle size distribution of the toner particles is expressed on the basis of volume and defined according to the following equation (Cv):

$$\text{Cv value (\%)} = (\text{Standard deviation in particle size distribution by number})/(\text{Median diameter in particle size distribution by number}) \times 100. \quad \text{Equation (Cv)}$$

A smaller Cv value indicates that the particle size distribution is sharper and means that the size of the toner particles is more uniform. That is, the Cv value falls within the above range, whereby toner particles whose size is uniform come to be obtained, so that a minute dot image or a fine line required for image formation by a digital system can be reproduced at higher precision. When a photographic image is formed, a high-quality photographic image of a level equal to or higher than an image prepared with a printing ink can be formed by using a small-diameter toner uniform in size.

According to such a production process of the toner as described above, the polyvalent organic acid or the salt thereof is used as the aggregation stopper when polysilicato-iron is used as the aggregating agent, whereby a sufficient aggregation-relaxing effect can be achieved, and moreover coloring by the polysilicato-iron can be inhibited. As a result, excellent toner particle size-controlling ability and moreover the sharpening of a particle size distribution are achieved, and the color of the resulting toner does not become dull. Accordingly, a toner for electrostatic image development, which has desired particle size and particle size distribution and attains high saturation, can be produced.

Developer:

The toner according to the present invention may be used as a magnetic or non-magnetic one-component developer, but may also be mixed with a carrier to be used as a two-component developer. When the toner according to the present invention is used as the two-component developer, as the carrier, may be used magnetic particles composed of a conventionally known material such as, for example, a metal or metal oxide such as iron, ferrite or magnetite, or an alloy of each of these metals with a metal such as aluminum or lead. In particular, ferrite particles are preferred. As the carrier, may also be used a coated carrier with the surfaces of magnetic particles coated with a coating such as a resin, or a dispersion type carrier with fine magnetic powder dispersed in a binder resin.

The volume-based median diameter of the carrier is preferably 20 to 100 μm, more preferably 25 to 80 μm. The volume-based median diameter of the carrier may be measured typically by a laser diffraction type particle size distribution measuring device "HELOS" (manufactured by SYMPATEC Co.) equipped with a wet dispersing machine.

As examples of preferred carriers, may be mentioned a resin-coated carrier with the surfaces of magnetic particles coated with a resin, and what is called a resin-dispersion type carrier with magnetic particles dispersed in a resin. No particular limitation is imposed on the resin making up the resin-coated carrier. However, examples thereof include olefin resins, styrene resins, styrene-acrylic resins, acrylic resins, silicone resins, ester resins and fluorine-containing polymer resins. As the resin making up the resin-dispersion type carrier, a publicly known resin may be used without being particularly limited. For example, an acrylic resin, styrene-acrylic resin, polyester resin, fluorine-containing resin, phenol resin or the like may be used.

The embodiments of the present invention have been specifically described above. However, embodiments of the present invention are not limited to the above embodiments, and various changes or modifications may be added thereto.

For example, the production process of the toner according to the present invention may also be applied to the production of a toner comprising toner particles of a core-shell structure, which are composed of core particles containing a binder resin and a shell layer covering the peripheral surfaces of the core particles and formed of a shell resin.

EXAMPLES

Specific Examples of the present invention will hereinafter be described. However, the present invention is not limited thereto. Measurements of the volume-based median diameter of fine binder resin particles, the volume-based median diameter of fine colorant particles, the volume-based median diameter of a toner and the Cv value were respectively conducted as described above.

Preparation Example 1 of Fine Binder Resin Particle Dispersion

Within a flask equipped with a stirrer, the following components were heated to 90° C. and dissolved to prepare a monomer solution.

| | |
|---|---|
| Styrene | 448 parts by mass |
| n-Butyl acrylate | 165 parts by mass |
| Methacrylic acid | 16 parts by mass |
| n-Octylmercaptan | 2 parts by mass |
| Paraffin wax "HNP-57" (product Of NIPPON SEIRO CO., LTD.) | 80 parts by mass. |

On the other hand, a surfactant solution with 8 parts by mass of sodium dodecylbenzenesulfonate dissolved in 1,780 parts by mass of ion-exchanged water was placed in a reaction vessel equipped with a stirrer, a temperature sensor, a condenser tube and a nitrogen inlet device and heated to 98° C., and the above-described monomer solution was mixed and dispersed in this surfactant solution for 8 hours by means of a mechanical dispersing machine "CLEARMIX" (manufactured by M TECHNIQUE CO., LTD.) having a circulating path to prepare a dispersion containing emulsified particles having a dispersion particle size of 330 nm.

An initiator solution with 10 parts by mass of potassium persulfate dissolved in 400 parts by mass of ion-exchanged water was then added into this dispersion, and this system was heated and stirred over 12 hours at 80° C., thereby conducting polymerization to obtain a dispersion [1] of fine binder resin particles.

Regarding this dispersion [1], the volume-based median diameter of the fine binder resin particles was measured and found to be 132 nm.

Preparation Example Y1 of Fine Colorant Particle Dispersion

One hundred parts by mass of a colorant "C.I. Pigment Yellow 74" was gradually added into 900 parts by mass of a 10% by mass aqueous solution of sodium dodecyl sulfate with stirring, and a dispersion treatment was then conducted by means of a stirring device "CLEARMIX" (manufactured by M TECHNIQUE CO., LTD.), thereby preparing a dispersion [Y1] of fine colorant particles.

The volume-based median diameter of the fine colorant particles in this dispersion [Y1] was measured and found to be 175 nm.

Production Example 1 of Toner

Example 1

The following components were placed in a reaction vessel equipped with a temperature sensor, a condenser tube, a nitrogen inlet device and a stirrer and stirred.

| | |
|---|---|
| Dispersion [1] of fine binder resin particles | 2105 parts by mass |
| Dispersion [Y1] of fine colorant particles | 200 parts by mass |
| Ion-exchanged water | 900 parts by mass. |

After the temperature within the vessel was controlled to 30° C., the pH of the resultant mixture was adjusted to 6.5 with sodium hydroxide. Then, 110 parts by mass of polysilicato-iron "PSI-025" (product of SUIDO KIKO KAISHA, LTD.; a molar ratio (Si/Fe) of silica to iron=0.25) was added over 10 minutes at 30° C. under stirring. After left to stand for 3 minutes, the heating of the system was started to raise the temperature to 85° C. over 60 minutes.

In this state, the particle size of aggregated particles was measured by means of "Multisizer 3" (manufactured by Beckmann Coulter Co.), and 55 parts by mass of the sodium salt of a compound represented by the formula (10-5) as above was added as an aggregation stopper at the time the volume-based median diameter ($D_{50}$) of the particles had reached 6.5 μm, thereby stopping the growth of the particle size. The aggregated particles were further heated and stirred over 3 hours at a liquid temperature of 85° C. as an aging treatment.

Thereafter, the reaction system was cooled to 30° C. at a cooling rate of 6° C./min, the pH was adjusted to 2, and the stirring was stopped.

The toner particles thus obtained were subjected to solid-liquid separation, washing with 15 liters of ion-exchanged water was conducted repeatedly 4 times. The toner particles were then dried with hot air of 40° C. to obtain a toner [1X] composed of the toner particles [1X].

One percent by mass of hydrophobic silica (number average primary particle size: 12 nm, degree of hydrophobization: 68) and 1% by mass of hydrophobic titanium oxide (number average primary particle size: 20 nm, degree of hydrophobization: 63) were added to the resultant toner particles [1X] and mixed by a Henschel mixer (manufactured by Mitsui Miike Engineering Corporation). Thereafter, coarse particles were removed by means of a sieve having a sieve opening of 45 μm, thereby producing a toner [1].

The volume-based median diameter and Cv value of this toner [1] were measured. The results are shown in Table 1.

Production Examples 2 to 7 of Toner

Examples 2 to 7

Toners [2] to [7] were obtained in the same manner as in Production Example 1 of toner except that the kind of the polysilicato-iron, the kind of the aggregation stopper and the amounts of them added were changed according to Table 1. Incidentally, both "PSI-050" and "PSI-075" of the aggregating agents are products of SUIDO KIKO KAISHA, LTD., and their molar ratios (Si/Fe) of silica to iron are respectively 0.5 and 0.75.

The volume-based median diameters and Cv values of these toners [2] to [7] were measured. The results are shown in Table 1.

Production Example 8 of Toner

Comparative Example 1

A comparative toner [8] was obtained in the same manner as in Production Example 1 of toner except that no aggregation stopper was added.

The volume-based median diameter and Cv value of this toner [8] were measured. The results are shown in Table 1.

Production Example 9 of Toner

Comparative Example 2

A comparative toner [9] was obtained in the same manner as in Production Example 1 of toner except that sodium hydroxide was added in place of 55 parts by mass of the sodium salt of the compound represented by the formula (10-5) as above as the aggregation stopper to adjust the pH to 6.9.

The volume-based median diameter and Cv value of this toner [9] were measured. The results are shown in Table 1.

Production Example 10 of Toner

Comparative Example 3

A comparative toner [10] was obtained in the same manner as in Production Example 1 of toner except that an aqueous aggregation stopper solution with 150 parts by mass (152 mmol per 1 L of the aqueous medium) of sodium chloride dissolved in 600 parts by mass of ion-exchanged water was added in place of 55 parts by mass of the sodium salt of the compound represented by the formula (10-5) as above as the aggregation stopper.

The volume-based median diameter and Cv value of this toner [10] were measured. The results are shown in Table 1.

Production Examples 1 to 10 of Developer (1) Preparation of Carrier

A high-speed mixing device equipped with a agitating blade was charged with 100 parts by mass of ferrite core particles and 5 parts by mass of cyclohexyl methacrylate/methyl methacrylate (copolymerization ratio: 5/5) copolymer resin particles, and stirring and mixing were conducted for 30 minutes at 120° C. to form a resin coating layer on the surfaces of the ferrite core particles by the action of mechanical impact force, thereby obtaining a ferrite carrier having a volume-based median diameter of 35 μm.

The volume-based median diameter of the carrier was measured by a laser diffraction type particle size distribution measuring device "HELOS" (manufactured by SYMPATEC Co.) equipped with a wet dispersing machine.

(2) Mixing of Toner and Carrier

The above-described carrier was added to each of the toners [1] to [10] in such a manner that the concentration of the toner is 6%, and mixing was conducted by a V-shape mixer, thereby producing developers [1] to [7] according to the present invention and comparative developers [8] to [10].

Each of these developers [1] to [10] was used to prepare a monochromatic solid image (test chart for color gamut measurement) of yellow (Y) that the size thereof is 2 cm×2 cm, and the amount of the toner applied is 4.0 g/m$^2$ by a default mode by means of a commercially available image forming apparatus "bizhub PRO C6500" (manufactured by Konica Minolta Business Technologies, Inc.).

With respect to this test chart for color gamut measurement, chromaticity of Y was measured under the following conditions by means of "Spectrolina/Scan Bundle" (manufactured by Gretag Macbeth Co.), and the chromaticity of Y measured was expressed on a*-b' coordinates to evaluate the test chart by saturation (chroma) C' calculated out according to the following equation (1). The results are shown in Table 1. Incidentally, when the saturation C* is 85 or more, no practical problem is caused, and so this developer is judged to be passed.

$$\text{Saturation } C^* = [(a^*)^2 + (b^*)^2]^{1/2} \qquad \text{Equation (1)}$$

Measuring Conditions:

Light source: D50 light source
Observation visual field: 2°
Density: ANSI T
White reference: Abs
Filter: UV Cut
Measuring mode: Reflectance
Language: Japanese

TABLE 1

| | | | Aggregation stopper | | Evaluation result | | |
|---|---|---|---|---|---|---|---|
| | Toner No. | Flocculant | Kind | Amount added (parts by mass) | $D_{50}$ (μm) | Cv value (%) | C* |
| Ex. 1 | 1 | PSI-025 | Sodium salt of compound (10-5) | 55 | 6.55 | 20.1 | 92 |
| Ex. 2 | 2 | PSI-025 | Sodium salt of compound (9-2) | 40 | 6.42 | 19.4 | 101 |
| Ex. 3 | 3 | PSI-025 | Sodium salt of compound (9-1) | 45 | 6.45 | 18.8 | 100 |
| Ex. 4 | 4 | PSI-025 | Sodium salt of compound (11-12) | 60 | 6.88 | 23.2 | 88 |
| Ex. 5 | 5 | PSI-050 | Sodium salt of compound (10-5) | 55 | 6.78 | 21.4 | 96 |
| Ex. 6 | 6 | PSI-075 | Sodium salt of compound (10-5) | 55 | 6.83 | 22.3 | 98 |
| Ex. 7 | 7 | PSI-025 | Compound (3-1) | 35 | 6.89 | 23.3 | 88 |
| Comp. Ex. 1 | 8 | PSI-025 | Not added | — | 22.4 | 34.2 | 59 |

TABLE 1-continued

| | Toner No. | Flocculant | Aggregation stopper Kind | Amount added (parts by mass) | Evaluation result $D_{50}$ (μm) | Cv value (%) | C* |
|---|---|---|---|---|---|---|---|
| Comp. Ex. 2 | 9 | PSI-025 | NaOH | — | 6.90 | 28.9 | 60 |
| Comp. Ex. 3 | 10 | PSI-025 | NaCl | 150 | 6.80 | 20.2 | 62 |

The invention claimed is:

1. A production process of a toner for electrostatic image development, which comprises toner particles containing at least a binder resin, the process comprising the steps of:

adding an aggregating agent containing polysilicato-iron into an aqueous medium in which fine binder resin particles have been dispersed;

aggregating and fusion-bonding the fine binder resin particles; and adding an aggregation stopper composed of a polyvalent organic acid or a salt thereof to the aqueous medium to stop the aggregating.

2. The production process of the toner for electrostatic image development according to claim 1, wherein the polyvalent organic acid or the salt thereof is an amino acid, a polyohosphoric acid or a salt thereof.

3. The production process of the toner for electrostatic image development according to claim 2, wherein the polyvalent organic acid or the salt thereof is an amino acid or a salt thereof.

4. The production process of the toner for electrostatic image development according to claim 3, wherein the polyvalent organic acid or the salt thereof is an amino acid having five or more carboxyl groups and/or hydroxyl groups or a salt thereof.

5. The production process of the toner for electrostatic image development according to claim 1, wherein the aqueous medium further comprises fine colorant particles; and the fine colored particles are aggregated together with the fine binder resin particles in the aggregating and fusion-bonding step.

6. The production process of the toner for electrostatic image development according to claim 1, wherein the polysilicato-iron has an average molecular weight of 200,000 to 500,000 daltons.

7. The production process of the toner for electrostatic image development according to claim 1, wherein the amount of the polysilicato-iron added is 1 to 100 mmol in terms of $[Fe_2O_3]$ per 1 L of the aqueous medium.

8. The production process of the toner for electrostatic image development according to claim 1, wherein the aqueous medium has a temperature which is not higher than a glass transition point the binder resin during the steps of adding the aggregating agent and the aggregating fusion-bonding.

9. The production process of the toner for electrostatic image development according to claim 1, wherein the aggregation stopper is added into the aqueous medium in an amount of 1 to 500 mmol per 1 L of the aqueous medium.

* * * * *